US009997037B2

(12) United States Patent
Yang

(10) Patent No.: US 9,997,037 B2
(45) Date of Patent: Jun. 12, 2018

(54) ANTI-THEFT TAG FOR ELECTRONIC DEVICE CHARGING PORT

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days. days.

(21) Appl. No.: 15/408,368

(22) Filed: Jan. 17, 2017

(65) Prior Publication Data

US 2017/0206762 A1 Jul. 20, 2017

Related U.S. Application Data

(60) Provisional application No. 62/279,287, filed on Jan. 15, 2016.

(51) Int. Cl.
*G08B 13/14* (2006.01)
*G08B 13/24* (2006.01)

(52) U.S. Cl.
CPC ..... *G08B 13/2434* (2013.01); *G08B 13/2448* (2013.01)

(58) Field of Classification Search
CPC ..... G08B 13/2434; G08B 3/10; G08B 13/06; G08B 13/2448; H04B 1/3883
USPC ..... 340/572.8, 568.1, 568.2, 568.4, 568.8, 340/571
See application file for complete search history.

(56) References Cited

U.S. PATENT DOCUMENTS 8,373,565 B2 * 2/2013 Yang ..... G08B 13/1463 340/10.1
8,452,868 B2 * 5/2013 Shafer ..... G06Q 10/087 340/568.1
8,890,694 B2 * 11/2014 Yang ..... H05K 5/0208 340/10.1
9,443,404 B2 * 9/2016 Grant ..... G08B 13/1445
9,521,227 B2 * 12/2016 Kim ..... H02G 3/185

* cited by examiner

*Primary Examiner* — Toan N Pham
(74) *Attorney, Agent, or Firm* — Brian W. Foxworthy; Robert R. Waters; Waters Law Group, PLLC

(57) ABSTRACT

An electronic article surveillance (EAS) device has a plug configured to fit a port of a portable electronic device. In some embodiments, the port used in the portable electronic device is a charging port. The EAS device may have an additional attaching mechanism to maintain the EAS device attached to a portable electronic device. In one embodiment, the additional attaching mechanism is a panel with an adhesive element. The EAS device may have a switch that changes state when the plug is inserted into the port. Electronics within the EAS device may monitor the switch and plug to detect attachment of the EAS device. The EAS device may also have a charging port in electrical continuity with the plug so that the electronic device can be charge with the EAS device in place.

37 Claims, 5 Drawing Sheets

ANTI-THEFT TAG FOR ELECTRONIC DEVICE CHARGING PORT

CROSS REFERENCE TO RELATED APPLICATIONS

This application is a utility application which claims priority to U.S. Provisional Application 62/279,287, filed on Jan. 15, 2016. The entire disclosures contained in the specification and figures for U.S. Provisional Application 62/279,287, including the attachments thereto, are incorporated herein by reference.

FIELD OF THE INVENTION

This invention relates to the prevention of the theft of electronic devices. More specifically, this invention relates to the prevention of the theft of rechargeable electronic devices by connecting an electronic article surveillance device to the charging port of the device.

BACKGROUND OF THE INVENTION

Theft of goods in the retail environment is a serious concern. Theft cuts into the margins of a business making it more difficult for a business to compete and succeed. Electronic devices are particularly targeted for theft, especially portable electronic devices; they are portable and have high value, both in cost and desirability. These portable electronic devices include cell phones, computer tablets, laptops, games, and DVD players, among other devices. Despite the theft risk, effective sales and marketing still requires that electronic devices be available for a consumer to hold and review to select the most desirable product for a particular consumer. Therefore there is a need for an effective way to protect electronic articles on display while giving a shopper the full ability to hold and inspect the product.

SUMMARY FOR EMBODIMENTS OF THE INVENTION

Portable electronics have onboard rechargeable batteries. To recharge the batteries, the portable electronic devices have ports for the connection of chargers. Typically, the chargers have a standard wall type plug, a transformer, cord length, and a plug for insertion into the charging port on the electronic device. Embodiments of the anti-theft tag for electronic device charging port connect to the charging port of the portable electronic device that it is protecting from theft.

Embodiments of the anti-theft tag have a housing. A plug compatible with the charging port of an electronic device extends from the housing at a first location. A plug like the charging port of the electronic device is positioned at a second location on the housing. In some embodiments of the anti-theft tag, there is electrical continuity between the plug on the housing compatible with the charging port and the plug like the charging port. This allows a charger to be plugged into the anti-theft tag to charge the electronic device, while the tag is plugged into the electronic device.

In addition to attaching to the electronic device with the plug compatible with the charging port, some embodiments of the anti-theft tag have additional mechanisms to attach to the electronic device. In some embodiments, the anti-theft tag has a panel with an adhesive element on it. When the tag is attached to the electronic device, the adhesive element contacts and adheres to the electronic device to maintain the tag in position on the electronic device. Some embodiments with the panel with the adhesive element have a hinge between the housing and the panel. The hinge facilitates the use of the adhesive panel. In practice, the tag is plugged into the charging port, and then the panel is brought into contact with the electronic device. Some embodiments of the tag have a double hinge between the housing and the panel. The double hinge gives an additional degree of freedom in bringing the panel into contact with the electronic device.

In some embodiments of the tag, the housing will enclose electronic article surveillance electronics. The EAS electronics may include a passive EAS element. Two types of possible passive EAS elements are acousto-magnetic (AM) passive elements which function at approximately 58 kHz frequency and ferrite core and coil passive elements. Both AM passive elements and core and coil passive elements generate signals in response to interrogation fields.

Some embodiments of the anti-theft tags may contain more active EAS electronic elements. These EAS electronics may comprise: a microprocessor; a motion sensor; a magnetometer; switches, wireless communication elements such as a radio frequency (RF) transmitter and receiver, or RF transceiver or an infrared communication port; an audible sound generator; and a battery, or other power source, powering the foregoing elements. The electronics can monitor the status of switches, the connections to the phone and charger, and the status of the battery. The microprocessor can execute machine readable instructions to interpret the state of switches, plugs, and sensors, to communicate with other devices, and to generate alarms if an alarm condition is determined.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figures 1, 2:
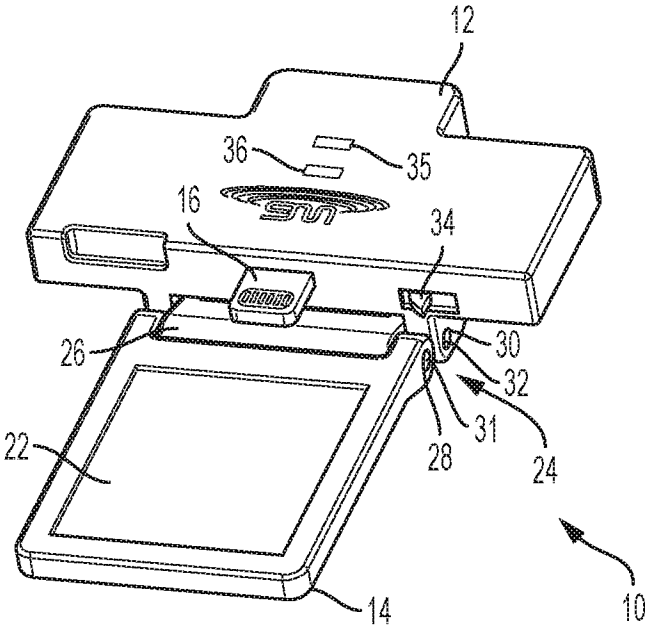
FIG. 1 is a first perspective view of an embodiment of the anti-theft tag for portable electronic devices.
FIG. 2 is a second perspective view of an embodiment of the anti-theft tag for portable electronic devices.
Figure 6:
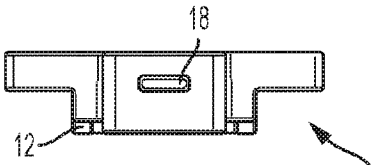
FIG. 6 is a first end view of an embodiment of the anti-theft tag for portable electronic devices.
Figure 7:
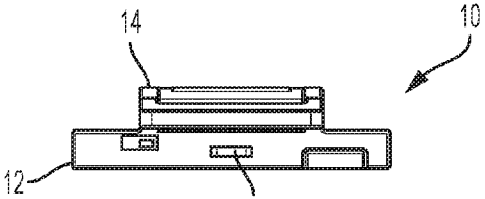
FIG. 7 is a second end view of an embodiment of the anti-theft tag for portable electronic devices.

FIG. 1 is a first perspective view of an embodiment of anti-theft tag 10 for portable electronic devices. FIG. 2 is a second perspective view of an embodiment of the anti-theft tag 10 for portable electronic devices. Tag 10 has body 12 and panel 14 extending from body 12. Also extending from body 12 is male plug 16. Male plug 16 is compatible with a respective female plug in an electronic device for which tag 10 is intended. This allows tag 10 to be attached to the respective electronic device by inserting male plug 16 into a feature inherent to the device.

Referring now to FIG. 1 only, female receptacle 18 is recessed into body 12 of tag 10. In embodiments of tag 10 having female receptacle 18, female receptacle 18 has electrical continuity with male plug 16. This allows the electronic device to be charged while tag 10 is plugged into the electronic device. This allows the electronic device to be maintained in a charged condition while it is available for review by consumers and protected by tag 10. In the embodiment shown in FIG. 1, female receptacle 18 is like the female receptacle of the respective electronic device, i.e. male plug 16 would fit in female receptacle 18. This provides the convenience that the charger that is intended for a given electronic device can be used to maintain the device in charged state while on display. However, the physical compatibility between male plug 16 and female receptacle 18 is not a requirement. It is only needed that a suitable electrical compatibility can be established between the charger and the electronic device. Similarly, male plug 16 and female receptacle 18 are located opposite of each other in FIG. 1, this is not a required arrangement.

In addition to plug 16, tag 10 may have an additional attaching mechanism for attaching tag 10 to a portable electronic device. In the embodiment of FIG. 1, panel 14 helps maintain tag 10 attached to the electronic device. In FIG. 1, adhesive element 20 is in place on panel 14. In FIG. 2, adhesive element 20 is absent and recess 22 is more fully visible. Once tag 10 is attached to an electronic device by inserting male plug 16 into a receptacle in the electronic device, adhesive element 20 on panel 18 is brought into contact with the electronic device to maintain tag 10 in place.

In some embodiments, panel 18 is connected to body 12 by a hinge to facilitate moving panel 18 and adhesive element 20 into contact with the electronic device. In the embodiment shown in FIG. 2, panel 18 is connected to body 12 by double hinge 24. Double hinge 24 gives an additional degree of freedom in applying adhesive element 20 to the electronic device. Coupler 26 between panel 18 and body 12 is hinged to both panel 18 and body 12 to form double hinge 24. Panel 18 has pin apertures 28 in panel 18 and body 12 has pin apertures 30 in body 12. Coupler 26 has pin apertures matching the pin apertures in panel 18 and body 12. Hinge pins 31 and 32 insert through pin apertures 28 and 30 and the matching apertures in coupler 26 to form double hinge 24.

Although adhesive element 20 maintains tag 10 on the electronic device under normal conditions, it may not be sufficient to prevent the forced removal of tag 10 by a determined thief. For that reason, some embodiments of tag 10 employ additional electronic monitoring elements capable of detecting when tag 10 has been removed without authorization and generating an alarm when the electronics determine an alarm condition. In FIG. 2, switch 34 protrudes from body 12 of tag 10. Switch 34 has at least two states; open, closed. When tag 10 is attached to an electronic device, switch 34 is depressed and its state is changed from the state it has when tag 10 is unattached. This change of state in switch 34 is registered by the electronics within tag 10 as indicating that tag 10 is attached to an electronic device, and tag 10 and the electronics within tag 10 may be said to be armed by switch 34. In some embodiments, the electronics within tag 10 will also monitor male plug 16 as a further indication that tag 10 has been attached to an electronic device. This may be done by registering a change in impedance. Depending on the embodiment of tag 10 and the machine executable instructions in its microprocessor, tag 10 may be armed by changes at switch 34, male plug 16, or both switch 34 and male plug 16.

Referring to both FIGS. 1 and 2, optical windows 35 and 36 allow optical communication by the electronics within body 12 of tag 10. Optical windows 35 and 36 may be open apertures or may have translucent coverings. The communication may take the form of the flashing from a light emitting diode (LED) in body 12 or the reception of infrared (IR), or other optical signals, at a receiving optical port in body 12. For example, a flashing LED could indicate when tag 10 has been armed, or an authorized person can use an external device to send IR signals to disarm the alarming functions of tag 10 before it is removed.

Figure 5:
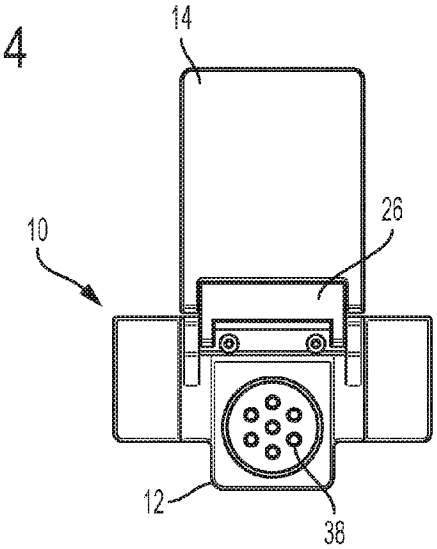
FIG. 5 is a second plan view of an embodiment of the anti-theft tag for portable electronic devices.
Figure 4:
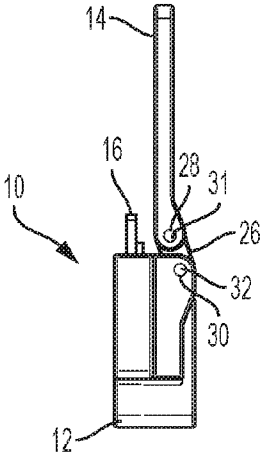
FIG. 4 is a side view of an embodiment of the anti-theft tag for portable electronic devices.
Figure 3:
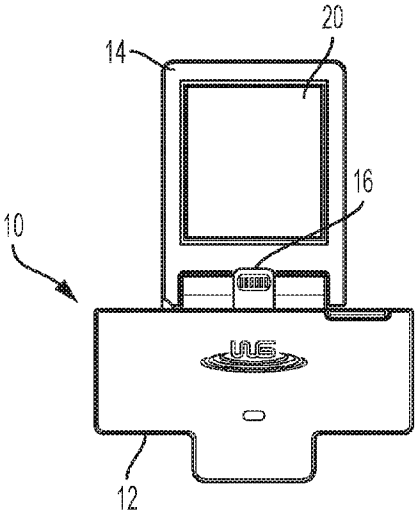
FIG. 3 is a first plan view of an embodiment of the anti-theft tag for portable electronic devices.

FIGS. 3, 4, 6 and 7 show additional views of embodiments having features already discussed with respect to the embodiments shown in FIGS. 1 and 2. FIG. 5, however, shows an embodiment of tag 10 and another possible set of features for tag 10. Sound apertures 38 in body 12 facilitate the sounding of audible alarms by an audible sound generator in the electronics within body 12 of tag 10.

Figure 8:
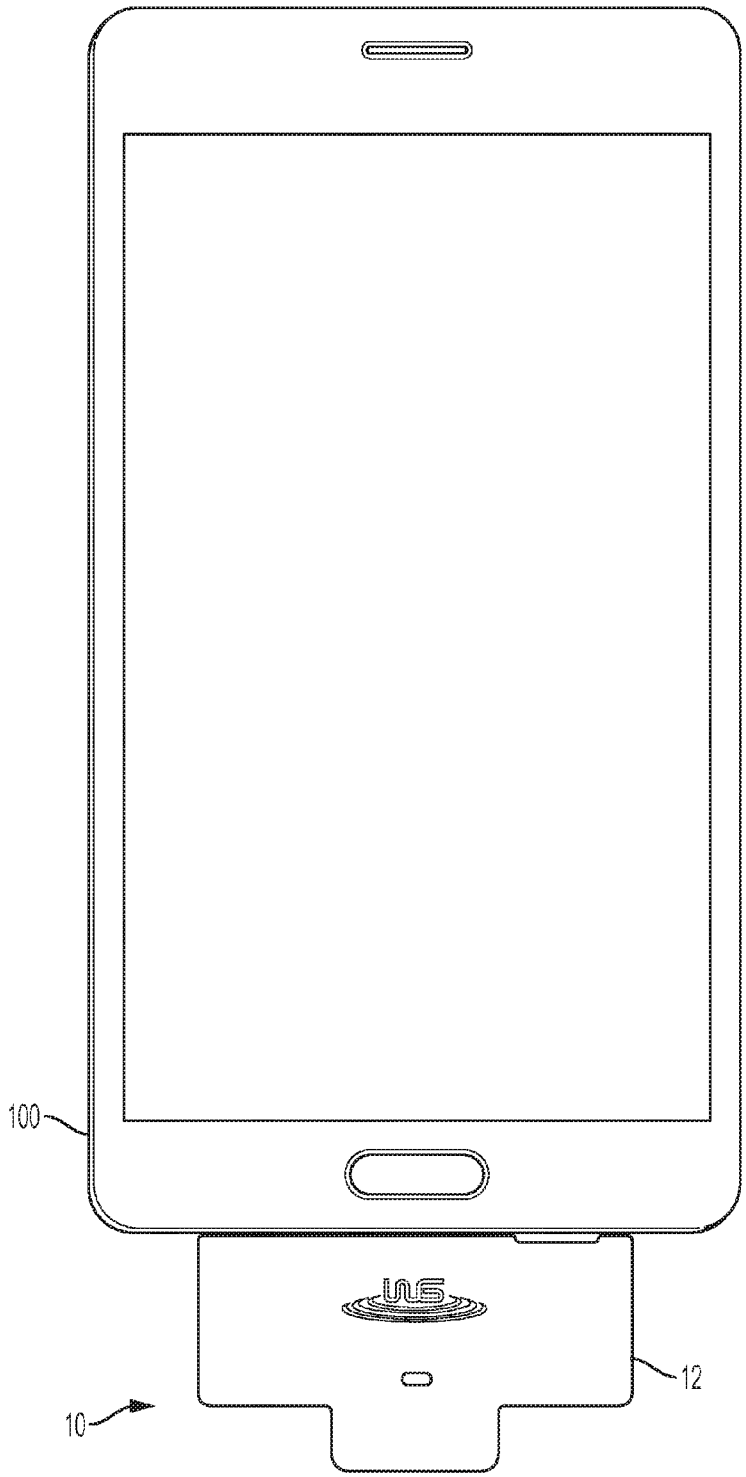
FIG. 8 is a first view of an embodiment of the anti-theft tag configured for cell phones and attached to a cell phone.
Figure 9:
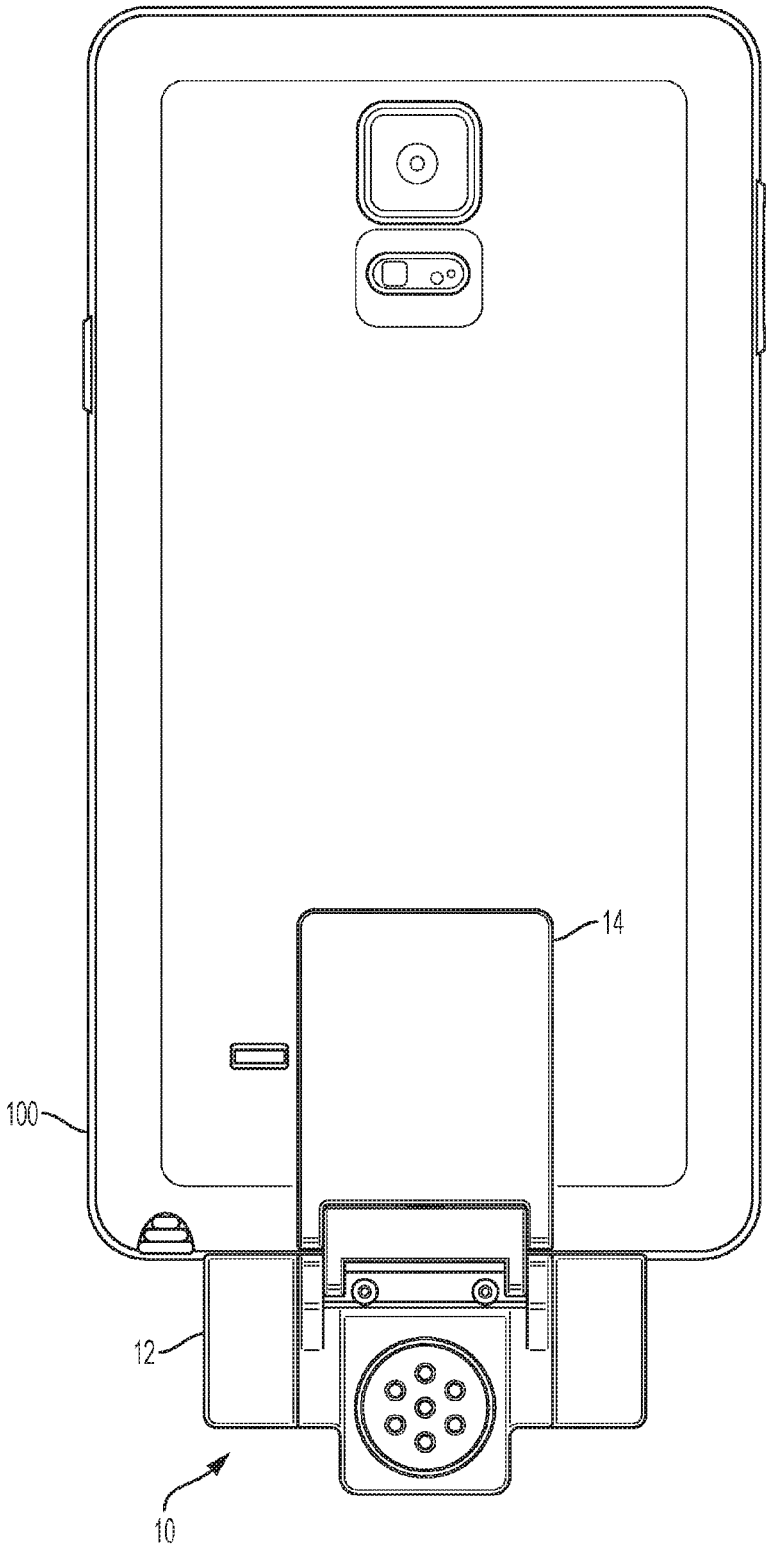
FIG. 9 is a second view of an embodiment of the anti-theft tag configured for cell phones and attached to a cell phone.

FIGS. 8 and 9 show of an embodiment of the anti-theft tag 10 configured for cell phones attached to a cell phone 100. Tag 10 is attached to the end of cell phone 100 where the charging port of cell phone 100 is located. Panel 14 is in contact with cell phone 100 and assists in maintaining tag 10 attached to cell phone 100. Although the embodiment of tag 10 in FIGS. 8 and 9 are sized and configured for a cell phone. Other embodiments may be sized and configured to fit other portable electronic devices having externally accessible ports or jacks.

Figure 10:
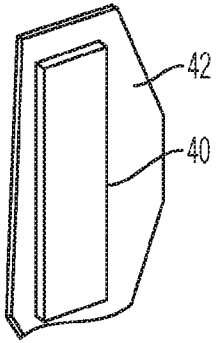
FIG. 10 is a perspective view of a passive anti-theft acousto-magnetic label attached to the interior of a section of housing.

FIG. 10 is a perspective view of a passive electronic article surveillance acousto-magnetic (AM) label 40 attached to the interior of a section of housing 42. AM labels such as label 40 are a common passive EAS element that function at approximately 58 kHz frequency within the radio frequency range. Frequently, anti-theft systems place field transmitting units at controlled locations to intermittently generate interrogation fields at a specific frequency. AM labels are tuned to generate response signals when energized by the specific frequency. The field transmitting units monitor for the label response signals between bursts of the interrogation field. When a label response is detected, the system evaluates the situation and may generate an alarm. Some embodiments of anti-theft tag 10 have an AM label 40 on the interior of body 12 to provide a way to detect the presence of tag 10 in controlled locations. A common operating frequency for systems using a label such as AM label 40 is 58 kHz. Radio communication circuitry 57 may operate at this frequency as well. However, radio communication circuitry 57 is not limited to this specific frequency or any other frequency.

Figure 11:
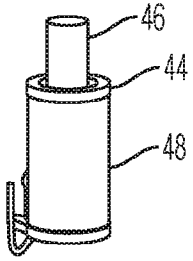
FIG. 11 is a perspective view of a passive anti-theft core and coil element.

FIG. 11 is a perspective view of a passive anti-theft core and coil element 44. Core and coil element 44 is comprised of a central ferrite core 46 with a conductive coil 48 wrapped around it. When subjected to a radio frequency field, core and coil element 44 is energized. When the field is removed, the energy dissipates, and core and coil element 44 generates a signal as it "rings" down. This signal can be detected by the EAS system. Core and coil element 44 can be tuned to the frequency of the field. Some embodiments of anti-theft tag 10 have a core and coil element 44 in the interior of body 12 to provide a way to detect the presence of tag 10 in controlled locations.

Figure 12:
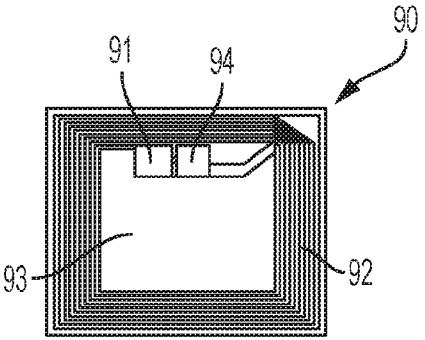
FIG. 12 is a schematic image of a passive RFID label.

FIG. 12 is a schematic image of RFID label 90 which is known in the art. Typically, RFID label 90 has IC chip 91 and antenna 92 mounted on substrate 93. Some RFID labels 90 may also have a capacitor 94 to improve some aspects of the performance of RFID label 90. IC chip 91 has memory which is accessible by external devices with radio frequency communication via antenna 92. Some IC chips 91 have rewritable memory and can have information about the objects to which they are attached written to their memory. RFID label 90 may be placed within body 12 of tag 10 to interact with a system that is already in place in a retail location. A common operating frequency for systems using a label such as RFID label 90 is 13.56 MHz. Radio communication circuitry 57 may operate at this frequency as well. However, radio communication circuitry 57 is not limited to this specific frequency or any other frequency.

Figure 13:
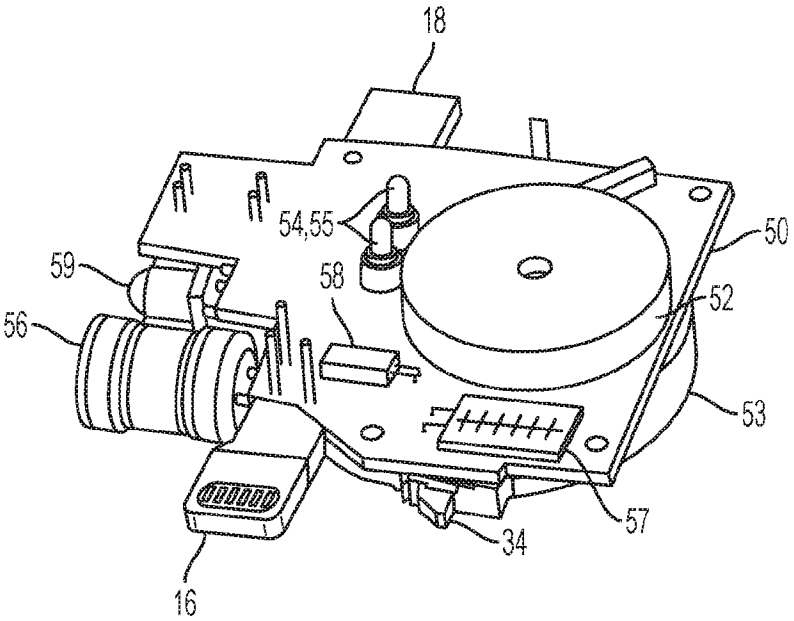
FIG. 13 is a perspective view of an embodiment of a set of electronic article surveillance electronics contained in embodiments of the anti-theft tag.

FIG. 13 is a perspective view of an embodiment of a set of electronic article surveillance electronics contained in embodiments of the anti-theft tag. Among the electronic elements that may be contained in body 12 are: circuit board 50; arming switch 34; microprocessor 52; audible sound generator 53; infrared communication port 54; light emitting diode 55; battery 56; radio communication circuitry 57; motion detection chip 58; and magnetometer 59. In addition to the elements just listed, the EAS electronics in tag 10 may include a passive EAS element, such as a passive core and coil element 44 or a passive acousto-magnetic label 40. Also, male plug 16 and female receptacle 18 may be monitored by microprocessor 52 and therefore may also be considered as elements of the EAS electronics set. In FIG. 13, male plug 16 and female receptacle 18 are offset from each other, rather than aligned with each other as in the embodiment of FIG. 1

Circuit board 50 and microprocessor 52 monitor several inputs and execute machine readable instructions and generate outputs based on the instructions and inputs. When male plug 16 is inserted into the female receptacle of an electronic device, switch 34 is depressed and its state is changed, arming the electronics in tag 10. Male plug 16 may also be monitored for confirmation that tag 10 is attached to an electronic device. The arming of anti-theft tag 10 may be automatic or it may be completed by communication from an external device. Other embodiments of anti-theft tag 10 may be armed by communication from an external device.

The final arming of anti-theft tag 10 may be automatic or it may be completed by communication from an external device. Infrared communications port 54 and radio communication circuitry 57 provide means for tag 10 to receive a signal from an external device such as a handheld device held by an authorized person. LED 55 and audible alarm generator 53 allow tag 10 to communicator directly to persons. When tag 10 is plugged into an electronic device, tag 10 may provide a confirmation signal by flashing LED 55 or issuing sounds from audible sound generator 53. An operator may then use an external device to send an optical signal to infrared communication port 54 or a radio signal to radio communication circuitry 57 to finalize arming tag 10.

An external device may also be used to disarm tag 10 before it is removed. Some embodiments of tag 10 will store a passcode in microprocessor 52. The external device must communicate the appropriate passcode before tag 10 will communicate with the external device or allow its status or machine readable instructions to be modified by the external device. The wrong passcode may itself be a cause to issue alarm.

Once tag 10 is installed, the electronics monitor at least switch 34. If tag 10 is removed without its electronics being disarmed, the electronics may determine an alarm condition and generate an alarm. This alarm may be an audible alarm generated by audible sound generator 53, a radio signal generated by radio communication circuitry 57, or an optical signal from LED 55. The radio signal alarm and optical signal alarm may be detected by elements in the electronic article surveillance system monitoring the area in which tag 10 and its respective electronic device are located. The EAS system may then respond as programmed, for example by sounding alarms, displaying alarms on computer screens, etc.

Radio communication circuitry 57 in tag 10 can also communicate with the EAS system to monitor the location of tag 10. Radio communication circuitry 57 can communicate actively with the EAS system or monitor for interrogation fields such as those used to stimulate passive EAS elements. If radio communication circuitry 57 detects an interrogation field, the electronics in tag 10 may determine an alarm condition and activate. Alternatively, the EAS system may instruct tag 10 to generate an alarm as well.

In some embodiments, the electronics of tag 10 are powered by battery 56. Some embodiments of tag 10 may also have a motion sensor 58. Motion sensor 58 may be employed to conserve battery life. Motion sensor 58 monitors for motion and is in communication microprocessor 52. After a preprogrammed period of stasis, with the exception of microprocessor 52 and motion sensor 58, the electronics of tag 10 go dormant. Motion sensor 58 monitors for movement of tag 10 and microprocessor 52 is in communication with motion sensor 58 to receive notice that tag 10 is being moved. When motion sensor 58 detects that tag 10 is in motion, the other electronic elements of tag 10 in addition to motion sensor 58 and microprocessor 52 become active. In some embodiments of tag 10, battery 56 may also be rechargeable when the charger for the electronic device is connected to female receptacle 18.

Magnetometer 59 provides another method for the electronics of tag 10 to monitor the status of tag 10 and its environment. Magnetometer 59 measures magnetic fields around tag 10 and communicates a digitized representation of the fields to microprocessor 52. Microprocessor 52 stores the digitized representations of the magnetic environment and compares them to each other over time for changes, consistency, etc. Sudden changes may indicate an alarm condition is present. For example, if the surrounding field is suddenly attenuated, it may be an indication that a thief has isolated tag 10 and its electronic device by placing them in a foil bag. In such a case, microprocessor 52 may issue an audible alarm from audible sound generator 53.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. An electronic article surveillance (EAS) device for a portable electronic device, the portable electronic device having a port for receiving a plug, said EAS device comprising:

a housing;

electronic article surveillance (EAS) electronics within said housing, said EAS electronics comprising a microprocessor, wireless communication elements, and a power supply;

a plug extending from said housing, said plug configured to insert into the port of the portable electronic device;

said EAS electronics monitoring said plug to detect attachment of the EAS device to the portable electronic device.

2. The EAS device of claim 1, further comprising:

an attaching mechanism in addition to said plug, said attaching mechanism maintaining said EAS device attached to the portable electronic device and maintaining said plug inserted into the port of the portable electronic device.

3. The EAS device of claim 2, wherein:

said attaching mechanism comprises a panel attached to said housing by a hinge, said panel having an adhesive element positioned to face the portable electronic device when said plug is inserted into the port of the portable electronic device.

4. The EAS device of claim 3, wherein:

said hinge is a compound hinge comprising a coupler intervening between said housing and said panel, said housing being pivotably connected to said coupler at a first pivot and said panel being pivotably connected to said coupler at a second pivot.

5. The EAS device of claim 1, wherein:

said EAS electronics further comprise a passive electronic article surveillance (EAS) element.

6. The EAS device of claim 1, wherein:

said plug is configured to insert into a charging port of the portable electronic device; and, said EAS device further comprises a charging port in said housing, said charging port configured to receive a plug from a charger for the portable electronic device, said charging port in said housing being in electrical continuity with said plug of said EAS device.

7. The EAS device of claim 1, wherein:

said wireless communication elements comprise radio frequency communication circuitry.

8. The EAS device of claim 1, wherein:

said wireless communication elements comprise optical communication elements.

9. The EAS device of claim 1, wherein:

said wireless communication elements comprise an audible sound generator.

10. The EAS device of claim 1, wherein:

said housing comprises a switch aperture located to face the portable electronic device when said plug is inserted into the port of the portable electronic device; and, said electronics further comprise a switch, said switch protruding through said switch aperture and having at least two states, open and closed, said switch contacting said portable electronic device and changing state when said plug is inserted into the port of the portable electronic device, said microprocessor monitoring said switch.

11. An electronic article surveillance (EAS) device for a portable electronic device, the portable electronic device having a port, said EAS device comprising:

a housing with a switch aperture;

a plug extending from said housing, said plug configured to insert into the port of the portable electronic device;

electronic article surveillance (EAS) electronics within said housing, said EAS electronics comprising a microprocessor, wireless communication elements, a power supply, and a switch protruding through said switch aperture, said switch aperture being located to face the portable electronic device when said plug is inserted into the port, said switch having at least two states, open and closed, said switch contacting said portable electronic device and changing state when said plug is inserted into the port of the portable electronic device, said EAS electronics monitoring said plug and said switch; and, an attaching mechanism in addition to said plug, said attaching mechanism maintaining said EAS device attached to the portable electronic device and maintaining said plug inserted into the port of the portable electronic device.

12. The EAS device of claim 11, wherein:

said attaching mechanism comprises a panel attached to said housing by a hinge, said panel having an adhesive element positioned to face the portable electronic device when said plug is inserted into the port of the portable electronic device.

13. The EAS device of claim 12, wherein:

said hinge is a compound hinge comprising a coupler intervening between said housing and said panel, said housing being pivotably connected to said coupler at a first pivot and said panel being pivotably connected to said coupler at a second pivot.

14. The EAS device of claim 11, wherein:

said EAS electronics comprise a passive electronic article surveillance (EAS) element.

15. The EAS device of claim 11, wherein:

said plug is configured to insert into a charging port of the portable electronic device; and, said EAS device further comprises a charging port in said housing, said charging port configured to receive a plug from a charger for the portable electronic device, said charging port in said housing being in electrical continuity with said plug.

16. The EAS device of claim 11, wherein:

said wireless communication elements comprise radio frequency communication circuitry.

17. The EAS device of claim 11, wherein:

said wireless communication elements comprise optical communication elements.

18. The EAS device of claim 11, wherein:

said wireless communication elements comprise an audible sound generator.

19. An electronic article surveillance (EAS) device for a portable electronic device, the portable electronic device having a charging port for receiving a plug, said EAS device comprising:

a housing;

electronic article surveillance (EAS) electronics within said housing;

a plug extending from said housing, said plug configured to insert into the charging port of the portable electronic device; and, a charging port in said housing, said charging port configured to receive the plug from a charger for the portable electronic device, said charging port in said housing being in electrical continuity with said plug of said EAS device.

20. The EAS device of claim 19, further comprising:

an attaching mechanism in addition to said plug, said attaching mechanism maintaining said EAS device attached to the portable electronic device and maintaining said plug inserted into the charging port of the portable electronic device.

21. The EAS device of claim 20, wherein:

said attaching mechanism comprises a panel attached to said housing by a hinge, said panel having an adhesive element positioned to face the portable electronic device when said plug is inserted into the charging port of the portable electronic device.

22. The EAS device of claim 21, wherein:

said hinge is a compound hinge comprising a coupler intervening between said housing and said panel, said housing being pivotably connected to said coupler at a first pivot and said panel being pivotably connected to said coupler at a second pivot.

23. The EAS device of claim 19, wherein:

said EAS electronics comprise a passive electronic article surveillance (EAS) element.

24. The EAS device of claim 19, wherein:

said EAS electronics comprise a microprocessor, wireless communication elements, and a power supply, said EAS electronics monitoring said plug extending from said housing to detect attachment to the portable electronic device.

25. The EAS device of claim 24, wherein:

said wireless communication elements comprise radio frequency communication circuitry.

26. The EAS device of claim 24, wherein:

said wireless communication elements comprise optical communication elements.

27. The EAS device of claim 24, wherein:

said wireless communication elements comprise an audible sound generator.

28. The EAS device of claim 24, wherein:

said housing comprises a switch aperture located to face the portable electronic device when said plug is inserted into the charging port of the portable electronic device; and, said electronics further comprise a switch, said switch protruding through said switch aperture and having at least two states, open and closed, said switch contacting said portable electronic device and changing state when said plug is inserted into the charging port of the portable electronic device, said microprocessor monitoring said switch.

29. An electronic article surveillance (EAS) device for a portable electronic device, the portable electronic device having a port for receiving a plug, said EAS device comprising:

a housing;

electronic article surveillance (EAS) electronics within said housing;

a plug extending from said housing, said plug configured to insert into the port of the portable electronic device; and an attaching mechanism, said attaching mechanism comprising a panel attached to said housing by a hinge, said panel having an adhesive element positioned to face the portable electronic device when said plug is inserted into the port of a portable electronic device, said attaching mechanism maintaining said EAS device attached to the portable electronic device and maintaining said plug inserted into the port of the portable electronic device.

30. The EAS device of claim 29, wherein:

said hinge is a compound hinge comprising a coupler intervening between said housing and said panel, said housing being pivotably connected to said coupler at a first pivot and said panel being pivotably connected to said coupler at a second pivot.

31. The EAS device of claim 29, wherein:

said EAS electronics comprise a passive electronic article surveillance (EAS) element.

32. The EAS device of claim 29, wherein:

said plug is configured to insert into a charging port of the portable electronic device; and, said EAS device further comprises a charging port in said housing, said charging port configured to receive a plug from a charger for the portable electronic device, said charging port in said housing being in electrical continuity with said plug of said EAS device.

33. The EAS device of claim 32, wherein:

said EAS electronics comprise a microprocessor, wireless communication elements, and a power supply, said EAS electronics monitoring said plug extending from said housing to detect attachment to the portable electronic device.

34. The EAS device of claim 33, wherein:

said wireless communication elements comprise radio frequency communication circuitry.

35. The EAS device of claim 33, wherein:

said wireless communication elements comprise optical communication elements.

36. The EAS device of claim 33, wherein:

said wireless communication elements comprise an audible sound generator.

37. The EAS device of claim 33, wherein:

said housing comprises a switch aperture located to face the portable electronic device when said plug is inserted into the charging port of the portable electronic device; and, said electronics further comprise a switch, said switch protruding through said switch aperture and having at least two states, open and closed, said switch contacting said portable electronic device and changing state when said plug is inserted into the charging port of the portable electronic device, said microprocessor monitoring said switch.

* * * * *